US005328619A

United States Patent [19]

Conary

[11] Patent Number: 5,328,619

[45] Date of Patent: Jul. 12, 1994

[54] OIL ADDITIVE CONCENTRATES AND LUBRICANTS OF ENHANCED PERFORMANCE CAPABILITIES

[75] Inventor: Gregory S. Conary, Columbia, Ill.

[73] Assignee: Ethyl Petroleum Additives, Inc., St. Louis, Mo.

[21] Appl. No.: 718,788

[22] Filed: Jun. 21, 1991

[51] Int. Cl.[5] ..... C10M 139/00; C10M 133/00

[52] U.S. Cl. ..... 252/32.5; 252/32.7 R; 252/32.7 E; 252/34; 252/45; 252/49.6; 252/50; 252/56 R

[58] Field of Search ..... 252/49.6, 32.5, 32.7 R, 252/32.7 E, 34, 45, 50, 56 R

[56] References Cited

U.S. PATENT DOCUMENTS

| | | | |
|---|---|---|---|
| 2,447,288 | 8/1948 | Smith et al. | 260/461 |
| 2,475,410 | 7/1949 | Smith et al. | 252/34 |
| 2,718,501 | 9/1955 | Harle | 252/47 |
| 2,958,663 | 11/1960 | Westcott et al. | 252/47.5 |
| 3,033,786 | 5/1962 | Vogel et al. | 252/34.7 |
| 3,087,936 | 4/1963 | Le Suer | 260/326.3 |
| 3,197,405 | 7/1965 | Le Suer | 252/32.7 |
| 3,197,496 | 7/1965 | Le Suer | 260/461 |
| 3,203,896 | 8/1965 | Latos et al. | 252/32.5 |
| 3,219,666 | 11/1965 | Norman et al. | 260/268 |
| 3,254,025 | 5/1966 | Le Suer | 252/49.6 |
| 3,281,428 | 10/1966 | Le Suer | 260/326.3 |
| 3,282,955 | 11/1966 | Le Suer | 252/49.6 |
| 3,284,409 | 11/1966 | Dorer | 252/49.9 |
| 3,284,410 | 11/1966 | Meinhardt | 252/49.6 |
| 3,338,832 | 8/1967 | Le Suer | 252/49.6 |
| 3,344,069 | 9/1967 | Stuebe | 252/49.6 |
| 3,345,292 | 10/1967 | Neale et al. | 252/47 |
| 3,389,083 | 6/1968 | Lyle et al. | 252/32.7 |
| 3,398,095 | 8/1968 | Judd | 252/47.5 |
| 3,502,677 | 3/1970 | Le Suer | 260/268 |
| 3,513,093 | 5/1970 | Le Suer | 252/32.5 |
| 3,533,945 | 10/1970 | Vogel | 252/49.6 |
| 3,652,411 | 3/1972 | Commichau | 252/34.7 |
| 3,658,836 | 4/1972 | Vineyard | 260/309.7 |
| 3,673,090 | 6/1972 | Waldbillig et al. | 252/45 |
| 3,703,536 | 11/1972 | Piasek et al. | 260/462 R |
| 3,718,663 | 2/1973 | Piasek et al. | 260/326.3 |
| 3,756,953 | 9/1973 | Piasek et al. | 252/49.6 |
| 3,796,661 | 3/1974 | Suratwala et al. | 252/45 |
| 3,879,306 | 4/1975 | Kablaoui et al. | 252/51.5 A |
| 3,901,932 | 8/1975 | Tada et al. | 260/455 P |
| 4,056,531 | 11/1977 | Malec | 260/268 PL |

(List continued on next page.)

FOREIGN PATENT DOCUMENTS

| | | |
|---|---|---|
| 0020037 | 12/1980 | European Pat. Off. . |
| 0049133 | 4/1982 | European Pat. Off. . |
| 0086513 | 8/1983 | European Pat. Off. . |
| 0378176 | 7/1990 | European Pat. Off. . |
| 0389237 | 9/1990 | European Pat. Off. . |
| 0391653 | 10/1990 | European Pat. Off. . |
| 0399764 | 11/1990 | European Pat. Off. . |
| 0430624 | 6/1991 | European Pat. Off. . |
| 0434464 | 6/1991 | European Pat. Off. . |
| 0448207 | 9/1991 | European Pat. Off. . |
| 0459656 | 12/1991 | European Pat. Off. . |
| 8503709 | 8/1985 | PCT Int'l Appl. . |
| 8605508 | 9/1986 | PCT Int'l Appl. . |
| 8707637 | 12/1987 | PCT Int'l Appl. . |
| 8707638 | 12/1987 | PCT Int'l Appl. . |
| 9009386 | 8/1990 | PCT Int'l Appl. . |
| 1111837 | 5/1968 | United Kingdom . |
| 1542113 | 3/1979 | United Kingdom . |

*Primary Examiner*—Ellen M. McAvoy
*Attorney, Agent, or Firm*—John F. Sieberth

[57] ABSTRACT

Haze formation in additive concentrates containing boron-containing ashless dispersants is inhibited, and improvements in performance capabilities can be realized, by suitably controlling the pH of the concentrate as produced. Not only does such pH control result in no sacrifice in wear and corrosion inhibition, but it has been found possible by suitable adjustment and control of pH to actually improve the effectiveness of the concentrate in its ability to inhibit wear and corrosion. Moreover, such pH control makes possible the provision of compositions having enhanced extreme pressure properties as seen in the standard L-42 test, and improved antirust performance as seen in the standard L-33 test.

48 Claims, No Drawings

U.S. PATENT DOCUMENTS

| | | | |
|---|---|---|---|
| 4,102,796 | 7/1978 | Lowe | 252/47.5 |
| 4,116,877 | 9/1978 | outten et al. | 252/72 |
| 4,161,451 | 7/1979 | Lowe | 252/32.7 E |
| 4,163,729 | 8/1979 | Adams | 252/18 |
| 4,177,153 | 12/1979 | Lowe | 252/32.7 E |
| 4,234,435 | 11/1980 | Meinhardt et al. | 252/51.5 A |
| 4,263,155 | 4/1981 | Frost | 252/49.8 |
| 4,295,983 | 10/1981 | Papay et al. | 252/49.6 |
| 4,317,739 | 3/1982 | Spence | 252/47.5 |
| 4,338,205 | 7/1982 | Wisotsky | 252/49.6 |
| 4,374,033 | 2/1983 | Malec | 252/49.6 |
| 4,428,849 | 1/1984 | Wisotsky | 252/33.4 |
| 4,459,215 | 7/1984 | Salentine | 252/32.5 |
| 4,462,918 | 7/1984 | Matthews et al. | 252/32.7 E |
| 4,472,288 | 9/1984 | Frost, Jr. | 252/32.7 E |
| 4,478,604 | 10/1984 | Schuettenberg | 44/63 |
| 4,521,318 | 6/1985 | Karol | 252/46.7 |
| 4,549,974 | 10/1985 | Horodysky | 252/33.6 |
| 4,554,086 | 11/1985 | Karol et al. | 252/49.6 |
| 4,566,879 | 1/1986 | Horodysky | 44/71 |
| 4,575,431 | 3/1986 | Salentine | 252/32.7 E |
| 4,582,943 | 4/1986 | Kristen et al. | 568/582 |
| 4,589,992 | 5/1986 | Phillips et al. | 252/75 |
| 4,615,818 | 10/1986 | DiBiase et al. | 252/47.5 |
| 4,640,787 | 2/1987 | Schuettenberg | 252/51.5 A |
| 4,652,387 | 3/1987 | Andress, Jr. et al. | 252/49.6 |
| 4,659,488 | 4/1987 | Vinci | 252/33 |
| 4,686,055 | 8/1987 | Horodysky | 252/32.7 E |
| 4,717,490 | 1/1988 | Salentine | 252/32.7 E |
| 4,744,912 | 5/1988 | Cardis | 252/46.7 |
| 4,755,311 | 7/1988 | Burjes et al. | 252/49.9 |
| 4,755,316 | 7/1988 | Magid et al. | 252/68 |
| 4,822,507 | 4/1989 | Kanamori et al. | 252/49.5 |
| 4,839,071 | 6/1989 | Gutierrez et al. | 252/51.5 A |
| 4,857,214 | 8/1989 | Papay et al. | 252/32.5 |
| 4,963,275 | 10/1990 | Gutierrez et al. | 252/47 |
| 4,971,711 | 11/1990 | Lundberg et al. | 252/49.6 |
| 4,981,492 | 1/1991 | Blain et al. | 44/317 |
| 4,985,156 | 1/1991 | Ashjian et al. | 252/49.6 |
| 5,021,176 | 6/1991 | Bullen et al. | 252/51.5 A |

OIL ADDITIVE CONCENTRATES AND LUBRICANTS OF ENHANCED PERFORMANCE CAPABILITIES

TECHNICAL FIELD

This invention relates to additive concentrates and oleaginous compositions (i.e., lubricating oils and functional fluids) having enhanced properties, especially as regards storage stability, antiwear performance, and extreme pressure performance.

BACKGROUND

Heretofore a number of additive concentrates containing, inter alia, sulfur-containing antiwear and/or extreme pressure additives, phosphorus-containing antiwear and/or extreme pressure additives, and other additive components have been proposed and used. Among such other additive components are acidic components such as carboxylic acids, hydrocarbyl phosphoric acids, and hydrocarbyl thiophosphoric acids; basic components such as amines; and ashless dispersants such as boronated succinimides.

Many such additive concentrates as supplied are highly acidic in character, exhibiting pH values (as determined by the method described hereinafter) in the range of about 4.0 to about 5.5. Such acidity arises by virtue of use in the concentrates of acidic additives to control wear and corrosion.

THE INVENTION

This invention, in part, involves the discovery that when a boronated ashless dispersant is included within an acidic additive concentrate of the foregoing type, a haze tends to develop in the concentrate after a period of storage at ambient temperature. It is believed that under such acidic conditions and in the presence of air, especially air of relatively high humidity, inorganic boron species—presumably boron oxides or boron acids—are gradually liberated in the concentrate to thereby form the haze.

A need thus exists for an effective way of inhibiting haze formation in such additive concentrates especially during exposure to air of relatively high humidity without impairing the performance characteristics of the concentrate and of oils of lubricating viscosity containing the same. Indeed, it would be of inestimable value to have a way of accomplishing this objective while at the same time improving upon the performance capabilities of the compositions involved.

This invention, in part, further involves the discovery that it is indeed possible to inhibit such haze formation, and further that improvements in performance capabilities can be realized, by suitably controlling the pH of the concentrate as produced. Not only does such pH control result in no sacrifice in wear and corrosion inhibition, but it has been found possible by suitable adjustment and control of pH to actually improve the effectiveness of the concentrate in its ability to inhibit wear and corrosion.

Moreover, the practice of this invention makes possible the provision of compositions having enhanced extreme pressure properties as seen in the standard L-42 test, and improved antirust performance as seen in the standard L-33 test.

In accordance with one of its embodiments this invention provides improved methods and compositions wherein an additive concentrate is formed from a combination of components which include (i) one or more (i.e., a complement of) oil-soluble acidic organic additives at least one of which is a hydrocarbyl phosphoric acid or a carboxylic acid, and (ii) one or more oil-soluble ashless boronated dispersants. The improvement involves including in the concentrate one or more oil-soluble amines in an amount such that the pH of the finished concentrate as formed falls in the range of about 6.0 to about 7.0 (preferably in the range of about 6.4 to about 7.0, more preferably in the range of about 6.60 to about 6.95, and most preferably in the range of about 6.70 to about 6.95), and introducing the boronated dispersant into the concentrate when the pH of the concentrate being formed is at least about 6.0. In each case the aforesaid pH is as determined in accordance with the method described hereinafter.

Other embodiments of this invention include the following:

I. In an additive concentrate comprising at least one oil-soluble amine salt of a dihydrocarbyl monothiophosphoric acid, at least one oil-soluble active-sulfur-containing antiwear or extreme pressure agent, and a complement of oil-soluble acidic organic additives at least one of which is a hydrocarbyl phosphoric acid, the improvement wherein said concentrate contains a sufficient amount of oil-soluble primary amine to provide a concentrate having a pH in the range of about 6.0 to about 7.0 as determined in accordance with the method described hereinafter.

II. A concentrate as described in I. above wherein the at least one oil-soluble amine salt is formed by charging to a reactor the following components in the following order: (1) at least one active-sulfur-containing component, (2) at least one dihydrocarbyl hydrogen phosphite, and (3) at least one amine; and while agitating the reactor contents, controlling and maintaining the temperature at about 55° to about 60° C.

III. A concentrate as described in II. above wherein the at least one active-sulfur-containing compound is sulfurized olefin, wherein the at least one dihydrocarbyl hydrogen phosphite is dialkyl hydrogen phosphite, and wherein the at least one amine comprises aliphatic monoamine having in the range of about 8 to about 24 carbon atoms per molecule.

IV. A concentrate as described in I. above wherein the pH is in the range of about 6.4 to about 7.0, more preferably in the range of about 6.60 to about 6.95, and most preferably in the range of about 6.70 to about 6.95.

V. A concentrate as described in I. above wherein the oil-soluble primary amine consists essentially of one or more aliphatic monoamines having in the range of about 14 to about 24 carbon atoms per molecule.

VI. A concentrate as described in V. above wherein such primary amine further includes a small amount of aliphatic monoamine having less than 14 carbon atoms in the molecule.

VII. A concentrate as described in I. above wherein such primary amine consists essentially of a mixture of $C_{16}$ and $C_{18}$ aliphatic monoamines (preferably a mixture of $C_{16}$ and $C_{18}$ saturated and olefinically unsaturated aliphatic monoamines) together with a small amount of aliphatic monoamine having less than 16 carbon atoms in the molecule.

VIII. A concentrate as described in I. above wherein the complement of oil-soluble acidic organic additives additionally includes (a) at least one aliphatic monocarboxylic acid, (b) at least one aliphatic polycarboxylic acid, or (c) a combination of (a) and (b).

IX. A concentrate as described in I. above further including at least one oil-soluble ashless dispersant.

X. A concentrate as described in IX. above wherein the oil-soluble ashless dispersant is a boron-containing ashless dispersant and wherein the boron-containing ashless dispersant is introduced into the concentrate after the pH thereof is at least about 6.0.

XI. A concentrate as described in I. above further including at least one oil-soluble copper corrosion inhibitor in an amount such that the concentrate exhibits a 1*b* rating or better in the ASTM D-130 procedure in the form referred to hereinafter.

XII. A concentrate as described in XI. above wherein the pH is in the range of about 6.70 to about 6.95.

XIII. A concentrate as described in I. above wherein:

A) the oil-soluble amine salt of a dihydrocarbyl monothiophosphoric acid is formed by a process which comprises (i) introducing, at a rate such that the temperature does not exceed about 60° C., dialkyl hydrogen phosphite into sulfurized branched-chain olefin while agitating the mixture so formed, (ii) introducing into this mixture, at a rate such that the temperature does not exceed about 60° C., one or more aliphatic primary monoamines having in the range of about 8 to about 20 carbon atoms in the molecule while agitating the mixture so formed, and (iii) maintaining the temperature of the resultant agitated reaction mixture at between about 55° and about 60° C. until reaction is substantially complete;

B) the hydrocarbyl phosphoric acid consists essentially of dialkyl phosphoric acid or a combination of dialkyl phosphoric acid and monoalkyl phosphoric acid, and is present in the reaction mixture of A) during at least a portion of the time (iii) thereof is being conducted;

C) the complement of oil-soluble acidic organic additives includes at least one aliphatic dicarboxylic acid having about 36 carbon atoms in the molecule; and D) the concentrate further includes at least one oil-soluble copper corrosion inhibitor in an amount such that the concentrate exhibits a lb rating or better in the ASTM D-130 procedure in the form referred to hereinafter.

XIV. A concentrate as described in XIII. above further including (a) at least one oil-soluble succinimide, (b) at least one oil-soluble succinic ester, or (c) at least one oil-soluble succinic ester-amide, or a combination of any two or all three of (a), (b) and (c).

XV. A concentrate as described in XIII. above further including (a) at least one oil-soluble boronated succinimide, (b) at least one oil-soluble boronated succinic ester, or (c) at least one oil-soluble boronated succinic ester amide, or (d) a combination of any two or all three of (a), (b) and (c), whichever of the foregoing (a), (b), (c) or (d) is included in the concentrate being introduced therein after the pH thereof is at least about 6.0.

XVI. An ashless additive concentrate formed from at least the following: (a) at least one oil-soluble sulfur-containing antiwear and/or extreme pressure agent, (b) at least one oil-soluble phosphorus-containing antiwear and/or extreme pressure agent, (c) at least one oil-soluble acidic organic additive, (d) at least one oil-soluble amine, and (e) at least one oil-soluble boronated ashless dispersant; such concentrate being further characterized in that (i) in the absence of component (d) the pH of the concentrate is 6.0 or below, (ii) component (d) is employed in an amount sufficient to cause the pH of the concentrate to be in the range of about 6.0 to about 7.0, and (iii) component (e) is introduced into the concentrate when the pH thereof is at least about 6.0, the determination of the aforesaid pH values being in accordance with the method described hereinafter.

XVII. In the method of forming an additive concentrate from a plurality of oil-soluble components which include at least one acidic organic component and at least one boronated ashless dispersant by blending the components of the concentrate concurrently or sequentially and individually or in one or more sub-combinations, the improvement which comprises (a) including as at least one component in such blending operation a sufficient amount of oil-soluble amine to adjust the pH of the concentrate to at least 6.0, preferably at least 6.4, more preferably at least 6.6, and most preferably at least 6.7, and (b) blending such one or more boronated ashless dispersants into the concentrate such that at no point in the blending is such boronated ashless dispersant exposed to a pH below 6.0 (or, preferably, below 6.4, or, more preferably, below 6.6, or, most preferably, below 6.7), the determination of the aforesaid pH values being in accordance with the method described hereinafter.

XVIII. The improvement according to XVII. above wherein the plurality of oil-soluble components further comprises at least one oil-soluble active-sulfur-containing antiwear and/or extreme pressure agent and at least one oil-soluble phosphorus-containing antiwear and/or extreme pressure agent; wherein the oil-soluble amine consists essentially of one or more aliphatic primary amines; and wherein the pH of the finished concentrate as determined in accordance with the method described hereinafter is in the range of 6.0 and 7.0.

XIX. The improvement according to XVIII. above wherein the plurality of oil-soluble components further comprises at least one oil-soluble copper corrosion inhibitor in an amount such that the concentrate exhibits a lb rating or better in the ASTM D-130 procedure in the form referred to hereinafter, and wherein said pH of the finished concentrate as formed is in the range of about 6.40 to about 6.95, and preferably in the range of about 6.70 to about 6.95.

XX. In an additive concentrate comprising at least one oil soluble amine salt of a dihydrocarbyl monothiophosphoric acid, at least one oil-soluble active-sulfur-containing antiwear or extreme pressure agent, and a complement of oil-soluble acidic organic additives at least one of which is carboxylic acid, the improvement wherein said concentrate contains a sufficient amount of oil-soluble primary amine to provide a concentrate having a pH in the range of about 6.0 to about 7.0 as determined in accordance with the method described hereinafter. The improvements according to I. through XX. above result in enhancement of antiwear and extreme pressure performance as compared to the corresponding more acidic concentrates and to methods involving the corresponding more acidic concentrates. In the case of X. and XV. through XIX. there is additionally achieved the advantage of inhibition of haze formation during storage.

The above and other embodiments and features of this invention will be apparent from a consideration of the ensuing description.

Amines

Any oil-soluble, suitably basic amine or combination of amines can be employed in the practice of this invention. Thus use can be made of oil-soluble, suitably basic primary, secondary and tertiary amines, or mixtures thereof, and such amines can be acyclic or cyclic monoamines or polyamines. They can be homocyclic or heterocyclic. And whether cyclic or acyclic, the amines can contain substituents, such as hydroxyl groups, sulfhydryl groups, thioether linkages, and the like, which do not interfere with the performance capabilities of the amine or the compositions in which the substituted amine is incorporated. Such substituents should be such as not to significantly alter the predominantly hydrocarbonaceous character of the organic portion of the amine.

Generally speaking, the preferred amines are aliphatic amines, especially the saturated or olefinically unsaturated aliphatic primary amines, such as n-octylamine, 2-ethylhexylamine, tert-octylamine, n-decylamine, the $C_{10}$, $C_{12}$, $C_{14}$ and $C_{16}$ tertiary alkyl primary amines (either singly or in any combinations thereof, such as a mixture of the $C_{12}$ and $C_{14}$ tertiary alkyl primary amines), n-undecylamine, lauryl amine, hexadecylamine, heptadecylamine, octadecylamine, the $C_{22}$ and $C_{24}$ tertiary alkyl primary amines (either singly or in combination), decenylamine, dodecenylamine, palmitoleylamine, oleylamine, linoleylamine, eicosenylamine, etc. Also desirable are the saturated or substantially saturated aliphatic secondary amines, such as di-iso-amylamine, di-n-octylamine, di-(2ethylhexyl)amine, di-(tert-octyl)amine, di-n-nonylamine, dilauryl amine, di-hexadecylamine, di-octadecylamine, di-oleylamine, etc.

Other suitable amines are exemplified by cyclohexyl dimethyl amine, 1,2-propylene diamine, 1,3-propylene diamine, diethylene triamine, triethylene tetramine, tetraethylene pentamine, ethanolamine, diethanolamine, pyridine, morpholine, trioctyl amine, N-(2-aminoethyl-)ethanolamine, 2-methylpiperazine, 1,2-bis(N-piperazinylethane), N,N'-bis(N-piperazinyl)piperazine, 2-methylimidazoline, 3-aminopiperidine, 2-aminopyridine, 2-(β-aminoethyl)-3-pyrroline, 3-aminopyrrolidine, N-(3-aminopropyl)morpholine, methylaminopropylene diamine, N-(βB-aminoethyl)piperazine, N,N'-di(β-aminoethyl)piperazine, N,N'-di(β-aminoethyl-)imidazolidone-2, N-(β-cyanoethyl)ethane-1,2-diamine, 1,3,6,9-tetraaminooctadecane, 1,3,6-triamino-9-oxadecane, N-methyl-1,2-propanediamine, bis(aminopropyl)ethylenediamine, N-hexylaniline, and the like.

Preferred amines are alkyl monoamines and alkenyl monoamines having from about 8 to about 24 carbon atoms in the molecule.

To achieve optimal performance in the L-33 rust test, it is preferred to employ oil-soluble aliphatic amines in which the aliphatic group is a primary aliphatic group. Commercially available mixtures of suitable primary aliphatic amines in the $C_{12}$ to $C_{18}$ range include Armeen O and Armeen OD (Akco Chemical), and Kemamine P-999 (Humko Chemical). To achieve optimal performance in the ASTM D-2711 demulsibility test, it is preferred to use oil-soluble aliphatic amines in which the aliphatic group is a tertiary aliphatic group, most preferably a tertiary alkyl group. Commercially available mixtures of suitable amines of this type include Primene 81-R and Primene JMT amines (Rohm & Haas Chemical Company).

Acidic organic additives

One preferred type of acidic components which can be used in the compositions of this invention comprises the oil-soluble hydrocarbyl phosphoric acids, such as the monohydrocarbyl phosphoric acids, the dihydrocarbyl phosphoric acids, and mixtures of mono- and dihydrocarbyl phosphoric acids. Sulfur-containing analogs of these hydrocarbyl phosphoric acids can also be employed, such as the monohydrocarbyl monothiophosphoric acids, the dihydrocarbyl monothiophosphoric acids, the monohydrocarbyl dithiophosphoric acids, the dihydrocarbyl dithiophosphoric acids, and the mono- and dihydrocarbyl tetrathiophosphoric acids. Mixtures of two or more of such sulfur-containing ester-acids, and mixtures of one or more hydrocarbyl phosphoric acids with one or more of such sulfur-containing ester-acids can also be used. The hydrocarbyl groups can be acyclic or cyclic and in either case, saturated or unsaturated. They should of course be of suitable size and configuration as to render the ester-acid soluble in the proportion selected for use both in the additive concentrate and in the base oil in which the concentrate is to be employed.

Examples of such ester-acids include di-n-hexyl phosphoric acid, di-n-octyl phosphoric acid, di-(2-ethylhexyl) phosphoric acid, mono-(2-ethylhexyl) phosphoric acid, di-n-decyl phosphoric acid, monodecyl phosphoric acid, di-n-undecyl phosphoric acid, monoundecyl phosphoric acid, di-n-dodecyl phosphoric acid, monododecyl phosphoric acid, di-n-tridecyl phosphoric acid, monotridecyl phosphoric acid, di-n-tetradecyl phosphoric acid, monotetradecyl phosphoric acid, di-n-hexadecyl phosphoric acid, monohexadecyl phosphoric acid, di-n-octadecyl phosphoric acid, monooctadecyl phosphoric acid, di-oleyl phosphoric acid, monooleyl phosphoric acid, dicyclohexyl phosphoric acid, 2-phenethyl phosphoric acid, dibenzyl phosphoric acid, diphenyl phosphoric acid, di-tolyl phosphoric acid, dicyclohexenyl phosphoric acid, and the like, including mixtures of two or more such compounds. Preferred mixtures of the hydrocarbyl phosphoric acids include di-(2-ethylhexyl) phosphoric acid and mono-(2-ethylhexyl) phosphoric acid; di-n-dodecyl phosphoric acid and di-n-tetradecyl phosphoric acid; diisooctyl phosphoric acid and mono-isooctyl phosphoric acid; and the like.

The hydrocarbyl monothiophosphoric acids are illustrated by such compounds as dibutyl thiophosphoric acid, dihexyl thiophosphoric acid, diheptyl thiophosphoric acid, decyl thiophosphoric acid, octadecyl thiophosphoric acid, di-(methylcycloheptyl) thiophosphoric acid, dixylyl thiophosphoric acid, docosenyl thiophosphoric acid, and like compounds, including mixtures thereof.

Examples of the hydrocarbyl dithiophosphoric acids include diisopropyl dithiophosphoric acid, 2,4-pentanediyl dithiophosphoric acid, di-sec-butyl dithiophosphoric acid, di-amyl dithiophophoric acid, n-octyl dithiophosphoric acid, di-n-octyl dithiophosphoric acid, hexadecenyl dithiophosphoric acid, di-(2-ethylhexyl) dithiophosphoric acid, diphenyl dithiophosphoric acid, dibenzyl dithiophosphoric acid, and the like. Analogous hydrocarbyl ester-acids of the trithiophosphoric acids and of tetrathiophosphoric acid can also be used, either singly or in admixture with each other, or in admixture with other phosphoric and/or thiophosphoric and/or dithiophosphoric acids.

Other types of acidic additive components which can be present in the compositions of this invention include oil-soluble monocarboxylic acids and/or polycarboxylic acids, and oil-soluble partially esterified or partially aminated polycarboxylic acids. Such compounds are often used as rust inhibitors or corrosion inhibitors. Examples of such materials include such monocarboxylic acids as 2ethylhexanoic acid, lauric acid, myristic acid, palmitic acid, oleic acid, linoleic acid, linolenic acid, behenic acid, cerotic acid, and the like. Typical oil-soluble polycarboxylic acids include dimer and trimer acids, such as are produced from tall oil fatty acids, oleic acid, linoleic acid, or the like; alkenylsuccinic acids in which the alkenyl group contains 10 or more carbon atoms such as, for example, tetrapropenylsuccinic acid, tetradecenylsuccinic acid, hexadecenylsuccinic acid, and the like.; long-chain $\alpha,\omega$-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. The corresponding half amides of such alkenyl succinic acids are also useful.

Boronated ashless dispersants

Typical procedures for producing boronated ashless dispersants involve heating one or more ashless dispersants such as those of the types described hereinafter under the caption "Ashless dispersants" with at least one boron compound under conditions yielding a boron-containing composition. Suitable compounds of boron useful in forming boronated ashless dispersants suitable for use in the compositions of this invention include, for example, boron acids, boron oxides, boron esters, and amine or ammonium salts of boron acids. Illustrative compounds include boric acid (sometimes referred to as orthoboric acid), boronic acid, tetraboric acid, metaboric acid, pyroboric acid, esters of such acids, such as mono-, di-, and tri-organic esters with alcohols or polyols having up to 20 or more carbon atoms (e.g., methanol, ethanol, 2-propanol, propanol, butanols, pentanols, hexanols, ethylene glycol, propylene glycol, trimethylol propane, diethanol amine, etc.), boron oxides such as boric oxide and boron oxide hydrate, and ammonium salts such as ammonium borate, ammonium pyroborate, etc. While usable, boron halides such as boron trifluoride, boron trichloride, and the like, are undesirable as they tend to introduce halogen atoms into the boronated dispersant, a feature which is detrimental from the environmental, toxicological and conservational standpoints. Amine borane addition compounds and hydrocarbyl boranes can also be used, although they tend to be relatively expensive. The preferred boron reagent is boric acid, $H_3BO_3$.

For further details concerning boronated ashless dispersants and procedures for conducting the boronation operation, reference may be had, for example, to the disclosures of U.S. Pat. Nos. 3,087,936; 3,254,025; 3,281,428; 3,282,955; 3,284,410; 3,338,832; 3,344,069; 3,533,945; 3,718,663; 4,097,389; 4,554,086; and 4,634,543. The disclosures of these patents are incorporated herein by reference.

Active-sulfur-containing antiwear and/or extreme pressure agents

Typical active-sulfur-containing antiwear and/or extreme pressure additives include dihydrocarbyl polysulfides; sulfurized olefins; sulfurized fatty acid esters of both natural (e.g. sperm oil) and synthetic origins; trithiones; sulfurized thienyl derivatives; sulfurized terpenes; sulfurized oligomers of $C_2$–$C_8$ monoolefins; and sulfurized Dieis-Alder adducts such as those disclosed in reissue U.S. Pat. No. 27,331, the disclosure of which is incorporated herein by reference. Specific examples include sulfurized polyisobutene of $\overline{M}n$ 1,100, sulfurized isobutylene, sulfurized triisobutene, dicyclohexyl polysulfide, diphenyl and dibenzyl polysulfide, di-tert-butyl polysulfide, and dinonyl polysulfide, among others.

Phosphorus-containing antiwear .and/or extreme pressure agents

Generally speaking there are two principal categories of phosphorus-containing antiwear and/or extreme pressure agents: metal salts of phosphorus acids, and metal-free phosphorus compounds. The metal salts are the oil-soluble salts of a metal such as copper, cadmium, calcium, magnesium, and most notably, zinc, and of a suitable acidic compound of phosphorus, such as a thiophosphoric acid, a dithiophosphoric acid, a trithiophosphoric acid, a tetrathiophosphoric acid or of a complex acidic product formed by phosphosulfurizing a hydrocarbon such as one or more olefins or terpenes with a reactant such as phosphorus pentasulfide and hydrolyzing the resultant product. Methods of forming such metal salts are well known to those skilled in the art and are extensively described in the patent literature.

The oil-soluble metal-free phosphorus-containing antiwear and/or extreme pressure agents are for the most part partially or fully esterified acids of phosphorus. Such compounds include for example phosphates, phosphites, phosphonates, phosphonites, and their various sulfur analogs. Examples include monohydrocarbyl phosphites; monohydrocarbyl phosphates; monohydrocarbyl mono-, di-, tri-, and tetrathiophosphites; monohydrocarbyl mono-, di-, tri-, and tetrathiophosphates; dihydrocarbyl phosphites; dihydrocarbyl phosphates; dihydrocarbyl mono-, di-, tri-, and tetrathiophosphites; dihydrocarbyl mono-, di-, tri-, and tetrathiophosphates; trihydrocarbylphosphites; trihydrocarbylphosphates; trihydrocarbyl mono-, di-, tri-, and tetrathiophosphites; trihydrocarbyl mono-, di-, tri-, and tetrathiophosphates; the various hydrocarbyl phosphonates and thiophosphonates; the various hydrocarbyl phosphonites and thiophosphonites, and analogous oil-soluble derivatives of polyphosphoric and polythiophosphoric acids; and many others. A few specific examples of such compounds are tricresyl phosphate, tributyl phosphite, triphenyl phosphite, tri-(2-ethylhexyl) phosphate, dihexyl thiophosphite, diisooctyl butylphosphonate, tricyclohexyl phosphate, cresyl diphenyl phosphate, tris(2butoxyethyl) phosphite, diisopropyl dithiophosphate, tris(tridecyl)tetrathiophosphate, tris(2-chloroethyl) phosphate, and like compounds.

Preferred ashless (i.e., metal-free) phosphorus-containing antiwear and/or extreme pressure agents for use in the practice of this invention are (a) the oil-soluble amine salts of monohydrocarbyl monothiophosphoric acids, (b) the oil-soluble amine salts of dihydrocarbyl monothiophosphoric acids, and (c) combinations of (a) and (b). Such compounds can be made by reacting a mono- and/or dihydrocarbyl phosphite with sulfur or an active sulfur-containing compound such as are referred to above under the caption "Active-sulfur-containing antiwear and/or extreme pressure agents" and one or more primary or secondary amines. Such reactions tend to be highly exothermic reactions which can become uncontrollable, if not conducted properly. The preferred method of forming these amine salts involves a process which comprises (i) introducing, at a rate such that the temperature does not exceed about 60° C., one or more dihydrocarbyl hydrogen phosphites, such as a dialkyl hydrogen phosphite, into an excess quantity of one or more active-sulfur-containing materials, such as sulfurized branched-chain olefin (e.g., isobutylene, diisobutylene, triisobutylene, etc.), while agitating the mixture so formed, (ii) introducing into this mixture, at a rate such that the temperature does not exceed about 60° C., one or more aliphatic primary or secondary amines, preferably one or more aliphatic primary monoamines having in the range of about 8 to about 24 carbon atoms per molecule while agitating the mixture so formed, and (iii) maintaining the temperature of the resultant agitated reaction mixture at between about 55° and about 60° C. until reaction is substantially complete. Another suitable way of producing these amine salts is to concurrently introduce all three of the reactants into the reaction zone at suitable rates and under temperature control such that the temperature does not exceed about 60° C.

Ashless dispersants

Any of a variety of ashless dispersants can be utilized in the compositions of this invention. These include the following types:

Type A—Carboxylic Ashless Dispersants. These are reaction products of an acylating agent (e.g., a monocarboxylic acid, dicarboxylic acid, polycarboxylic acid, or derivatives thereof) with one or more polyamines and/or polyhydroxy compounds. These products, herein referred to as carboxylic ashless dispersants, are described in many patents, including British Patent Specification 1,306,529 and the following U.S. Patents which are incorporated herein by reference: U.S. Pat. Nos. 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and Re 26,433.

There are a number of sub-categories of carboxylic ashless dispersants. One such sub-category which constitutes a preferred type for use in the formation of component b) is composed of the polyamine succinamides and more preferably the polyamine succinimides in which the succinic group contains a hydrocarbyl substituent containing at least 30 carbon atoms. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. Representative examples of such dispersants are given in U.S. Pat. Nos. 3,172,892; 3,202,678; 3,216,936; 3,219,666; 3,254,025; 3,272,746; and 4,234,435, the disclosures of which are incorporated herein by reference. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to about 180°–220° C. The olefin is preferably a polymer or copolymer of a lower monoolefin such as ethylene, propylene, 1-butene, isobutene and the like. The more preferred source of alkenyl group is from polyisobutene having a number average molecular weight of up to 100,000 or higher. In a still more preferred embodiment the alkenyl group is a polyisobutenyl group having a number average molecular weight (determined using the method described in detail hereinafter) of about 500–5,000, and preferably about 700–2,500, more preferably about 700–1,400, and especially 800–1,200. The isobutene used in making the polyisobutene is usually (but not necessarily) a mixture of isobutene and other $C_4$ isomers such as 1-butene. Thus, strictly speaking, the acylating agent formed from maleic anhydride and "polyisobutene" made from such mixtures of isobutene and other $C_4$ isomers such as 1-butene, can be termed a "polybutenyl succinic anhydride" and a succinimide made therewith can be termed a "polybutenyl succinimide". However, it is common to refer to such substances as "polyisobutenyl succinic anhydride" and "polyisobutenyl succinimide", respectively. As used herein "polyisobutenyl" is used to denote the alkenyl moiety whether made from a highly pure isobutene or a more impure mixture of isobutene and other $C_4$ isomers such as 1-butene.

Polyamines which may be employed in forming the ashless dispersant include any that have at least one primary amino group which can react to form an imide group. A few representative examples include branched-chain alkanes containing two or more primary amino groups such as tetraamino-neopentane, etc.; polyaminoalkanols such as 2-(2-aminoethylamino)-ethanol and 2-[2-(2-aminoethylamino)-ethylamino]-ethanol; heterocyclic compounds containing two or more amino groups at least one of which is a primary amino group such as 1-(β-aminoethyl)-2-imidazolidone, 2-(2-aminoethylamino)-5-nitropyridine, 3-amino-N-ethylpiperidine, 2-(2-aminoethyl)-pyridine, 5-aminoindole, 3-amino-5-mercapto-1,2,4-triazole, and 4-(aminomethyl)-piperidine; and the alkylene polyamines such as propylene diamine, dipropylene triamine, di-(1,2-butylene)triamine, N-(2-aminoethyl)-1,3-propanediamine, hexamethylenediamine and tetra-(1,2-propylene)pentamine.

The most preferred amines are the ethylene polyamines which can be depicted by the formula $H_2N(CH_2CH_2NH)_nH$ wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. These ethylene polyamines have a primary amine group at each end so can form mono-alkenylsuccinimides and bis-alkenylsuccinimides. Commercially available ethylene polyamine mixtures usually contain minor amounts of branched species and cyclic species such as N-aminoethyl piperazine, N,N'-bis(aminoethyl)piperazine, N,N'-bis(piperazinyl)ethane, and like compounds. The preferred commercial mixtures have approximate overall compositions falling in the range corresponding to diethylene triamine to pentaethylene hexamine, mixtures generally corresponding in overall makeup to tetraethylene pentamine being most preferred. Methods for the production of polyalkylene polyamines are known and reported in the literature. See for example U.S. Pat. No. 4,827,037 and references cited therein, all disclosures of such patent and cited references being incorporated herein by reference.

Thus especially preferred ashless dispersants for use in the present invention are the products of reaction of a polyethylene polyamine, e.g. triethylene tetramine or tetraethylene pentamine, with a hydrocarbon-substituted carboxylic acid or anhydride (or other suitable acid derivative) made by reaction of a polyolefin, preferably polyisobutene, having a number average molecular weight of 500 to 5,000, preferably 700 to 2,500, more preferably 700 to 1,400 and especially 800 to 1,200, with an unsaturated polycarboxylic acid or anhydride, e.g., maleic anhydride, maleic acid, fumaric acid, or the like, including mixtures of two or more such substances.

As used herein the term "succinimide" is meant to encompass the completed reaction product from reaction between the amine reactant(s) and the hydrocarbon-substituted carboxylic acid or anhydride (or like acid derivative) reactant(s), and is intended to encompass compounds wherein the product may have amide, amidine, and/or salt linkages in addition to the imide linkage of the type that results from the reaction of a primary amino group and an anhydride moiety.

Residual unsaturation in the alkenyl group of the alkenyl succinimide may be used as a reaction site, if desired. For example the alkenyl substituent may be hydrogenated to form an alkyl substituent. Similarly the olefinic bond(s) in the alkenyl substituent may be sulfurized, halogenated, hydrohalogenated or the like. Ordinarily, there is little to be gained by use of such techniques, and thus the use of alkenyl succinimides as the precursor of component b) is preferred.

Another sub-category of carboxylic ashless dispersants which can be used in the compositions of this invention includes alkenyl succinic acid esters and diesters of alcohols containing 1-20 carbon atoms and 1-6 hydroxyl groups. Representative examples are described in U.S. Pat. Nos. 3,331,776; 3,381,022; and 3,522,179, the disclosures of which are incorporated herein by reference. The alkenyl succinic portion of these esters corresponds to the alkenyl succinic portion of the succinimides described above including the same preferred and most preferred subgenus, e.g., alkenyl succinic acids and anhydrides, etc., where the alkenyl group contains at least 30 carbon atoms and notably, polyisobutenyl succinic acids and anhydrides wherein the polyisobutenyl group has a number average molecular weight of 500 to 5,000, preferably 700 to 2,500, more preferably 700 to 1,400, and especially 800 to 1,200. As in the case of the succinimides, the alkenyl group can be hydrogenated or subjected to other reactions involving olefinic double bonds.

Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g., $C_1$-$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

Still another sub-category of carboxylic ashless dispersants useful in forming compositions of this invention comprises an alkenyl succinic ester-amide mixture. These may be made by heating the above-described alkenyl succinic acids, anhydrides or lower alkyl esters or etc. with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1-20 carbon atoms, 1-6 hydroxy groups and 1-4 amine nitrogen atoms. Examples are ethanolamine, diethanolamine, N-ethanol-diethylene triamine, and trimethylol aminomethane.

Here again, the alkenyl group of the succinic ester-amide can be hydrogenated or subjected to other reactions involving olefinic double bonds.

Representative examples of suitable ester-amide mixtures are referred to in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540, the disclosures of which are incorporated herein by reference.

Yet another sub-category of carboxylic ashless dispersants which can be used comprises the Mannich-based derivatives of hydroxyaryl succinimides. Such compounds can be made by reacting a polyalkenyl succinic anhydride with an aminophenol to produce an N-(hydroxyaryl) hydrocarbyl succinimide which is then reacted with an alkylene diamine or polyalkylene polyamine and an aldehyde (e.g., formaldehyde), in a Mannich-base reaction. Details of such synthesis are set forth in U.S. Pat. No. 4,354,950, the disclosure of which is incorporated herein by reference. As in the case of the other carboxylic ashless dispersants discussed above, the alkenyl succinic anhydride or like acylating agent is derived from a polyolefin, preferably a polyisobutene, having a number average molecular weight of 500 to 5,000, preferably 700 to 2,500, more preferably 700 to 1,400, and especially 800 to 1,200. Likewise, residual unsaturation in the polyalkenyl substituent group can be used as a reaction site as for example, by hydrogenation, sulfurization, or the like.

Type B—Mannich polyamine dispersants. This category of ashless dispersant which can be utilized in the compositions of this invention is comprised of reaction products of an alkyl phenol, with one or more aliphatic aldehydes containing from 1 to about 7 carbon atoms (especially formaldehyde and derivatives thereof), and polyamines (especially polyalkylene polyamines of the type described hereinabove). Examples of these Mannich polyamine dispersants are described in the following U.S. Patents, the disclosures of which are incorporated herein by reference thereto: 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,980,569; and 4,011,380.

The polyamine group of the Mannich polyamine dispersants is derived from polyamine compounds characterized by containing a group of the structure —NH— wherein the two remaining valances of the nitrogen are satisfied by hydrogen, amino, or organic radicals bonded to said nitrogen atom. These compounds include aliphatic, aromatic, heterocyclic and carbocyclic polyamines. The source of the oil-soluble hydrocarbyl group in the Mannich polyamine dispersant is a hydrocarbyl-substituted hydroxy aromatic compound comprising the reaction product of a hydroxy aromatic compound, according to well known procedures, with a hydrocarbyl donating agent or hydrocarbon source. The hydrocarbyl substituent provides substantial oil solubility to the hydroxy aromatic compound and, preferably, is substantially aliphatic in character. Commonly, the hydrocarbyl substituent is derived from a polyolefin having at least about 40 carbon atoms. The hydrocarbon source should be substantially free from pendant groups which render the hydrocarbyl group oil insoluble. Examples of acceptable substituent groups are halide, hydroxy, ether, carboxy, ester, amide, nitro and cyano. However, these substituent groups preferably comprise no more than about 10 weight percent of the hydrocarbon source.

The preferred hydrocarbon sources for preparation of the Mannich polyamine dispersants are those derived from substantially saturated petroleum fractions and olefin polymers, preferably polymers of mono-olefins having from 2 to about 30 carbon atoms. The hydrocarbon course can be derived, for example, from polymers of olefins such as ethylene, propene, 1-butene, isobutene, 1-octene, 1-methylcyclohexene, 2-butene and 3-pentene. Also useful are copolymers of such olefins with other polymerizable olefinic substances such as styrene. In general, these copolymers should contain at least 80 percent and preferably about 95 percent, on a weight basis, of units derived from the aliphatic monoolefins to preserve oil solubility. The hydrocarbon source generally contains at least about 40 and preferably at least about 50 carbon atoms to provide substantial oil solubility to the dispersant. The olefin polymers having a number average molecular weight between about 600 and 5,000 are preferred for reasons of easy reactivity and low cost. However, polymers of higher molecular weight can also be used. Especially suitable hydrocarbon sources are isobutylene polymers.

The Mannich polyamine dispersants are generally prepared by reacting a hydrocarbyl-substituted hydroxy aromatic compound with an aldehyde and a polyamine. Typically, the substituted hydroxy aromatic compound is contacted with from about 0.1 to about 10 moles of polyamine and about 0.1 to about 10 moles of aldehyde per mole of substituted hydroxy aromatic compound. The reactants are mixed and heated to a temperature above about 80° C. to initiate the reaction. Preferably, the reaction is carried out at a temperature from about 100° to about 250° C. The resulting Mannich product has a predominantly benzylamine linkage between the aromatic compound and the polyamine. The reaction can be carried out in an inert diluent such as mineral oil, benzene, toluene, naphtha, ligroin, or other inert solvents to facilitate control of viscosity, temperature and reaction rate.

Suitable polyamines for use in preparation of the Mannich polyamine dispersants include, but are not limited to, methylene polyamines, ethylene polyamines, butylene polyamines, propylene polyamines, pentylene polyamines, hexylene polyamines and heptylene polyamines. The higher homologs of such amines and related aminoalkyl-substituted piperazines are also useful. Specific examples of such polyamines include ethylene diamine, triethylene tetramine, tris(2-aminoethyl)amine, propylene diamine, pentamethylene diamine, hexamethylene diamine, heptamethylene diamine, octamethylene diamine, decamethylene diamine, di(heptamethylene) triamine, pentaethylene hexamine, di(trimethylene) triamine, 2-heptyl-3-(2-aminopropyl)imidazoline, 1,3-bis(2-aminoethyl)imidazoline, 1-(2-aminopropyl)piperazine, 1,4-bis(2-aminoethyl)piperazine and 2-methyl-1-(2-aminobutyl)piperazine. Higher homologs, obtained by condensing two or more of the above mentioned amines, are also useful, as are the polyoxyalkylene polyamines.

The polyalkylene polyamines, examples of which are set forth above, are especially useful in preparing the Mannich polyamine dispersants for reasons of cost and effectiveness. Such polyamines are described in detail under the heading "Diamines and Higher Amines" in Kirk-Othmer, *Encyclopedia of Chemical Technology*, Second Edition, Vol. 7, pp. 22–39. They are prepared most conveniently by the reaction of an ethylene imine with a ring-opening reagent such as ammonia. These reactions result in the production of somewhat complex mixtures of polyalkylene polyamines which include cyclic condensation products such as piperazines. Because of their availability, these mixtures are particularly useful in preparing the Mannich polyamine dispersants. However, it will be appreciated that satisfactory dispersants can also be obtained by use of pure polyalkylene polyamines.

Alkylene diamines and polyalkylene polyamines having one or more hydroxyalkyl substituents on the nitrogen atom are also useful in preparing the Mannich polyamine dispersants. These materials are typically obtained by reaction of the corresponding polyamine with an epoxide such as ethylene oxide or propylene oxide. Preferred hydroxyalkyl-substituted diamines and polyamines are those in which the hydroxyalkyl groups have less than about 10 carbon atoms. Examples of suitable hydroxyalkyl-substituted diamines and polyamines include, but are not limited to, N-(2-hydroxyethyl)ethylenediamine, N,N'-bis(2-hydroxyethyl)ethylenediamine, mono(hydroxypropyl)diethlenetriamine, (di(hydroxypropyl)tetraethylenepentamine and N-(3-hydroxybutyl)tetramethylenediamine. Higher homologs obtained by condensation of the above mentioned hydroxyalkyl-substituted diamines and polyamines through amine groups or through ether groups are also useful.

Any conventional formaldehyde yielding reagent is useful for the preparation of the Mannich polyamine dispersants. Examples of such formaldehyde yielding reagents are trioxane, paraformaldehyde, trioxymethylene, aqueous formalin and gaseous formaldehyde.

Type C—Polymeric polyamine dispersants. Also suitable for use in the compositions of this invention are polymers containing basic amine groups and oil solubilizing groups (for example, pendant alkyl groups having at least about 8 carbon atoms). Such polymeric dispersants are herein referred to as polymeric polyamine dispersants. Such materials include, but are not limited to, interpolymers of decyl methacrylate, vinyl decyl ether or a relatively high molecular weight olefin with aminoalkyl acrylates and aminoalkyl acrylamides. Examples of polymeric polyamine dispersants are set forth in the following patents, the disclosures of which are incorporated herein by reference: U.S. Pat. Nos. 3,329,658; 3,449,250; 3,493,520; 3,519,565; 3,666,730; 3,687,849; 3,702,300.

Type D—Post-treated ashless dispersants. Any of the ashless dispersants referred to above as types A-C can be subjected to post-treatment with one or more suitable reagents such as urea, thiourea, carbon disulfide, aldehydes, ketones, carboxylic acids, anhydrides of low molecular weight dibasic acids, nitriles, epoxides, phosphorus acids, phosphorus esters, and the like. Such post-treated ashless dispersants can be used in forming the compositions of this invention. Examples of post-treatment procedures and post-treated ashless dispersants are set forth in the following U.S. Patents, the disclosures of which are incorporated herein by reference: U.S. Pat. Nos. 3,036,003; 3,200,107; 3,216,936; 3,256,185; 3,278,550; 3,312,619; 3,366,569; 3,367,943; 3,373,111; 3,403,102; 3,442,808; 3,455,831; 3,455,832; 3,493,520; 3,502,677; 3,513,093; 3,573,010; 3,579,450; 3,591,598; 3,600,372; 3,639,242; 3,649,229; 3,649,659; 3,702,757; and 3,708,522; and 4,971,598.

Mannich-based derivatives of hydroxyaryl succinimides that have been post-treated with $C_5$–$C_9$ lactones such as $\epsilon$-caprolactone and optionally with other post-treating agents as described for example in U.S. Pat. No. 4,971,711 can also be utilized in the practice of this invention. The disclosures of U.S. Pat. No. 4,971,711, as well as related U.S. Pat. Nos. 4,820,432; 4,828,742; 4,866,135; 4,866,139; 4,866,140; 4,866,141; 4,866,142; 4,906,394; and 4,913,830 are incorporated herein by reference as regards additional suitable ashless dispersants which may be utilized.

Copper corrosion inhibitors

One type of such additives is comprised of thiazoles, triazoles and thiadiazoles. Examples of such compounds include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-(bis)hydrocarbyldithio)1,3,4-thiadiazoles. The preferred compounds are the 1,3,4-thiadiazoles, especially the 2,5-bis(hydrocarbylthio)-1,3,4-thiadiazoles, a number of which are available as articles of commerce. Such compounds are generally synthesized from hydrazine and carbon disulfide by known procedures. See for example U.S. Pat. Nos. 2,749,311; 2,760,933; 2,765,289; 2,850,453; 2,910,439; 3,663,561; 3,862,798; 3,840,549; and 4,097,387, the disclosures of which are incorporated herein by reference.

Other suitable corrosion inhibitors include ether amines; polyethoxylated compounds such as ethoxylated amines, ethoxylated phenols, and ethoxylated alcohols; imidazolines; and the like. Materials of these types are well known to those skilled in the art and a number of such materials are available as articles of commerce.

Other Additive Components

The oleaginous fluids and additive concentrates of this invention can and preferably will contain additional components in order to partake of the properties which can be conferred to the overall composition by such additional components. The nature of such components will, to a large extent, be governed by the particular use to which the ultimate oleaginous composition (lubricant or functional fluid) is to be subjected.

Antioxidants. Most oleaginous compositions will contain a conventional quantity of one or more antioxidants in order to protect the composition from premature degradation in the presence of air, especially at elevated temperatures. Typical antioxidants include hindered phenolic antioxidants, secondary aromatic amine antioxidants, sulfurized phenolic antioxidants, oil-soluble copper compounds, phosphorus-containing antioxidants, and the like.

Illustrative sterically hindered phenolic antioxidants include ortho-alkylated phenolic compounds such as 2,6-di-tertbutylphenol, 4-methyl-2,6-di-tert-butylphenol, 2,4,6-tri-tertbutylphenol, 2-tert-butylphenol, 2,6-diisopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tertbutylphenol, 2-methyl-6-styrylphenol, 2,6-distyryl-4-nonylphenol, and their analogs and homologs. Mixtures of two or more such mononuclear phenolic compounds are also suitable.

The preferred antioxidants for use in the compositions of this invention are methylene-bridged alkylphenols, and these can be used singly or in combinations with each other, or in combinations with sterically-hindered unbridged phenolic compounds. Illustrative methylene bridged compounds include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylene-bis(2,6-di-tertbutylphenol), and similar compounds. Particularly preferred are mixtures of methylene-bridged alkylphenols such as are described in U.S. Pat. No. 3,211,652, all disclosure of which is incorporated herein by reference.

Amine antioxidants, especially oil-soluble aromatic secondary amines can also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-$\alpha$-naphthylamine, phenyl-$\beta$-naphthylamine, alkyl- or aralkylsubstituted phenyl-$\alpha$-naphthylamine containing one or two alkyl or aralkyl groups each having up to about 16 carbon atoms, alkyl- or aralkyl-substituted phenyl-$\beta$naphthylamine containing one or two alkyl or aralkyl groups each having up to about 16 carbon atoms, and similar compounds.

A preferred type of aromatic amine antioxidant is an alkylated diphenylamine of the general formula

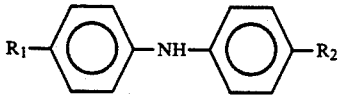

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominately a 4,4'-dinonyldiphenylamine (i.e., bis(4-nonylphenyl)amine) wherein the nonyl groups are branched.

Another useful type of antioxidant for inclusion in the compositions of this invention is comprised to one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15° C. to about 70° C., most preferably between about 40° C. to about 60° C.

Mixtures of different antioxidants can also be used. One suitable mixture is comprised of a combination of (i) an oil-soluble mixture of at least three different sterically-hindered tertiary butylated monohydric phenols which is in the liquid state at 25° C., (ii) an oil-soluble mixture of at least three different sterically-hindered tertiary butylated methylene-bridged polyphenols, and (iii) at least one bis(4-alkylphenyl)amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii).

Corrosion or Rust Inhibitors. The compositions of this invention may also contain a suitable quantity of a corrosion or rust inhibitor. This may be a single compound or a mixture of compounds having the property of inhibiting corrosion of ferrous metal surfaces. Such materials include dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; and the like. Materials of these types are well known to those skilled in the art and a number of such materials are available as articles of commerce.

Other useful corrosion inhibitors are aminosuccinic acids or derivatives thereof represented by the formula:

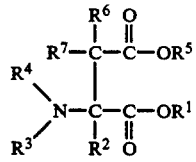

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ $R^4$, $R^6$ and $R^7$, when in the form of or hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred of the aminosuccinic acid derivatives is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

Antifoam Agents. Suitable antifoam agents include silicones and organic polymers such as acrylate polymers. Various antifoam agents are described in *Foam Control Agents* by H. T. Kerner (Noyes Data Corporation, 1976, pages 125–176), the disclosure of which is incorporated herein by reference. Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates.

Friction Modifiers. These materials include such substances as the alkyl phosphonates as disclosed in U.S. Pat. No. 4,356,097, aliphatic hydrocarbyl-substituted succinimides derived from ammonia or alkyl monoamines as disclosed in European Patent Publication No. 20037, dimer acid esters as disclosed in U.S. Pat. No.

4,105,571, oleamide, and the like. Such additives, when used are generally present in amounts of 0.1 to 5 weight percent. Glycerol oleates are another example of fuel economy additives and these are usually present in very small amounts, such as 0.05 to 0.2 weight percent based on the weight of the formulated oil. The patents and the patent publication referred to in this paragraph are incorporated herein by reference.

Other suitable friction modifiers include aliphatic amines or ethoxylated aliphatic amines, aliphatic fatty acid amides, aliphatic carboxylic acids, aliphatic carboxylic esters, aliphatic carboxylic ester-amides, aliphatic phosphates, aliphatic thiophosphonates, aliphatic thiophosphates, etc., wherein the aliphatic group usually contains above about eight carbon atoms so as to render the compound suitably oil soluble.

A desirable friction modifier additive combination which may be used in the practice of this invention is described in European Patent Publication No. 389,237, the disclosure of which is incorporated herein by reference. This combination involves use of a long chain succinimide derivative and a long chain amide.

Seal Swell Agents. Additives may be introduced into the compositions of this invention in order to improve the seal performance (elastomer compatibility) of the compositions. Known materials of this type include dialkyl diesters such as dioctyl sebacate, aromatic hydrocarbons of suitable viscosity such as Panasol AN-3N, products such as Lubrizol 730, polyol esters such as Emery 2935, 2936, and 2939 esters from the Emery Group of Henkel Corp. and Hatcol 2352, 2962, 2925, 2938, 2939, 2970, 3178, and 4322 polyol esters from Hatco Corp. Generally speaking the most suitable diesters include the adipates, azelates, and sebacates of $C_4$–$C_{13}$ alkanols (or mixtures thereof), and the phthalates of $C_4$–$C_{13}$ alkanols (or mixtures thereof). Mixtures of two or more different types of diesters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid.

Demulsifiers. Typical additives which may be employed as demulsifiers include alkyl benzene sulfonates, polyethylene oxides, polypropylene oxides, block copolymers of ethylene oxide and propylene oxide, salts and esters or oil soluble acids, and the like. Such additives are generally employed at concentration of up to about 3% in the additive concentrate.

As noted above, for optimal antirust performance as seen for example in the L-33 test, it is preferred to use oil-soluble aliphatic amines in which the aliphatic group is a primary aliphatic group. Since this type of amine serves an emulsifier, it is preferred to avoid use of a demulsifier in systems in which such amines are used. On the other hand, when the amine used is a tertiary aliphatic primary amine, excellent demulsibility is achieved and a supplemental demulsifier is not needed, but can be used. In general, use of supplemental demulsifiers tend to de-rate rust inhibition properties.

Base oils

The additive combinations of this invention can be incorporated in a wide variety of lubricants and functional fluids in effective amounts to provide suitable active ingredient concentrations. The base oils not only can be hydrocarbon oils of lubricating viscosity derived from petroleum (or tar sands, coal, shale, etc.), but also can be natural oils of suitable viscosities such as rapeseed oil, etc., and synthetic oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures of mineral, natural and/or synthetic oils in any proportion, etc. The term "base oil" for this disclosure includes all the foregoing.

The additive combinations of this invention can thus be used in lubricating oil and functional fluid compositions, such as automotive crankcase lubricating oils, automatic transmission fluids, gear oils, hydraulic oils, cutting oils, etc., in which the base oil of lubricating viscosity is a mineral oil, a synthetic oil, a natural oil such as a vegetable oil, or a mixture thereof, e.g. a mixture of a mineral oil and a synthetic oil.

Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art.

As is noted above, the base oil can consist essentially of or comprise a portion of one or more synthetic oils. Among the suitable synthetic oils are homo- and interpolymers of $C_2$–$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$–$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1000, diphenyl ether of polyethylene glycol having a molecular weight of 500–1000, diethyl ether of polypropylene glycol having a molecular weight of 1000–1500) or mono- and poly-carboxylic esters thereof, for example, the acetic acid ester, mixed $C_3$–$C_6$ fatty acid esters, or the $C_{13}$ Oxo acid diester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol).

Specific examples of these esters include dibutyl adipate, di(2-ethylhexyl) adipate, didodecyl adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, and the complex ester formed by reacting one mole of sebacic acid with two moles of tetraethylene glycol and two moles of 2-ethylhexanoic acid.

Esters which may be used as synthetic oils also include those made from $C_3$–$C_{12}$ monocarboxylic acids and polyols and polyol ethers such as neopentyl glycol, trimethylolpropane, pentaerythritol and dipentaerythritol. Trimethylol propane tripelargonate and pentaerythritol tetracaproate serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl) silicate, tetra-(p-tert-butylphenyl) silicate, poly(methyl)siloxanes, and poly(methylphenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$–$C_{16}$ α-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578, the disclosures of which are incorporated herein by reference. Additionally, hydrogenated 1-alkene oligomers of this type are available as articles of commerce, e.g., under the trade designations ETHYLFLO 162, ETHYLFLO 164, ETHYLFLO 166, ETHYLFLO 168, ETHYLFLO 170, ETHYLFLO 174, and ETHYLFLO 180 poly-α-olefin oils (Ethyl Corporation; Ethyl Canada Limited; Ethyl S.A.). Blends of such materials can also be used in order to adjust the viscometrics of the given base oil. Suitable 1-alkene oligomers are also available from other suppliers. As is well known, hydrogenated oligomers of this type contain little, if any, residual ethylenic unsaturation.

Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

It is also possible in accordance with this invention to utilize blends of one or more liquid hydrogenated 1-alkene oligomers in combination with other oleaginous materials having suitable viscosities, provided that the resultant blend has suitable compatibility and possesses the physical properties desired.

Typical natural oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and the like. Such oils may be partially or fully hydrogenated, if desired.

The fact that the base oils used in the compositions of this invention may be composed of (i) one or more mineral oils, (ii) one or more synthetic oils, (iii) one or more natural oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as high temperature stability, non-flammability or lack of corrosivity towards specific metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance.

Proportions and Concentrations

In general, the components of the additive compositions of this invention are employed in the oleaginous liquids (e.g., lubricating oils and functional fluids) in minor amounts sufficient to improve the performance characteristics and properties of the base oil or fluid. In the case of the amines, the amount employed is the amount sufficient to render the pH (determined as described hereinabove) of the finished additive concentrate as formed within the pH ranges set forth hereinabove. The amounts of the other components will vary in accordance with such factors as the use for which the composition is intended, the viscosity characteristics of the base oil or fluid employed, the viscosity characteristics desired in the finished product, the service conditions for which the finished product is intended, and the performance characteristics desired in the finished product. However, generally speaking, the following concentrations (weight percent) of the components (active ingredients, except in the case of viscosity index improvers which are on an as received basis) in the base oils or fluids are illustrative:

| | Typical Range | Preferred Range | More Preferred Range |
|---|---|---|---|
| S-contg antiwear/ E.P. agent | 0.25–5 | 0.7–4.5 | 1.5–4 |
| P-contg antiwear/ E.P. agent | 0.05–5 | 0.1–4 | 0.3–3 |
| B-contg ashless dispersant | 0.05–3 | 0.1–2 | 0.2–1.5 |
| Cu corrosion inhibitor | 0.001–0.25 | 0.005–0.2 | 0.01–0.15 |
| Antioxidant | 0–4 | 0–2 | 0–1 |
| Rust inhibitor | 0–0.5 | 0.001–0.4 | 1–0.3 |
| Foam inhibitor | 0–0.3 | 0.001–0.2 | 0.005–0.1 |
| B-free ashless dispersant | 0–2 | 0–1.5 | 0–1 |
| Pour point depressant | 0–5 | 0–4 | 0–3 |
| Viscosity index improver | 0–35 | 0–25 | 0–15 |
| Friction modifier | 0–3 | 0–2 | 0–1 |
| Seal swell agent | 0–30 | 0–20 | 0–15 |

-continued

| | Typical Range | Preferred Range | More Preferred Range |
|---|---|---|---|
| Dye | 0–0.1 | 0–0.05 | 0–0.04 |

Because the additive concentrates of this invention can be employed in the formulation of lubricants and functional fluid compositions for a wide variety of specialty uses, the above concentration ranges are not intended to limit this invention as departures can readily be made in any situation where a departure is deemed necessary or desirable.

It will be appreciated that the individual components can be separately blended into the base oil or fluid or can be blended therein in various subcombinations, if desired. Moreover, such components can be blended in the form of separate solutions in a diluent. Except for viscosity index improvers and/or pour point depressants (which are usually blended apart from other components), it is preferable to blend the other selected components into the base oil by use of an additive concentrate of this invention, as this simplifies the blending operations, reduces the likelihood of blending errors, and takes advantage of the compatibility and solubility characteristics afforded by the overall concentrate.

The additive concentrates of this invention will contain the individual components in amounts proportioned to yield finished oil or fluid blends consistent with the concentrations tabulated above. In most cases, the additive concentrate will contain one or more diluents such as light mineral oils, to facilitate handling and blending of the concentrate. Thus concentrates containing up to 50% by weight of one or more diluents or solvents can be used.

The oleaginous liquids provided by this invention can be used in a variety of applications. For example, they can be employed as crankcase lubricants, gear oils, hydraulic fluids, manual transmission fluids, automatic transmission fluids, cutting and machining fluids, brake fluids, shock absorber fluids, heat transfer fluids, quenching oils, transformer oils, and the like. The compositions are particularly suitable for use as automotive and industrial gear oils.

Blending

To make the compositions of this invention, one either purchases or synthesizes each of the respective individual components to be used in the formulation or blending operation. Unless one is already in the commercial manufacture of one or more such components, it is usually simpler and thus preferable to purchase, to the extent possible, the ingredients to be used in the compositions of this invention. If it is desired to synthesize one or more components, use may be made of synthesis procedures referred to in the literature, including, but by no means limited to, the applicable references cited and incorporated herein.

The formulation or blending operations are relatively simple and involve mixing together in a suitable container or vessel, using a dry, inert atmosphere where necessary or desirable, appropriate proportions of the selected ingredients. Those skilled in the art are cognizant of and familiar with the procedures suitable for formulating and blending additive concentrates and lubricant compositions. Usually the order of addition of components to the blending tank or vessel is not critical provided of course, that the components being blended at any given time are not incompatible or excessively reactive with each other. Agitation such as with mechanical stirring equipment is desirable to facilitate the blending operation. Frequently it is helpful to apply sufficient heat to the blending vessel during or after the introduction of the ingredients thereto, so as to maintain the temperature at, say, 40°–60° C., and preferably no higher than about 40° C. Similarly, it is sometimes helpful to preheat highly viscous components to a suitable temperature even before they are introduced into the blending vessel in order to render them more fluid and thereby facilitate their introduction into the blending vessel and render the resultant mixture easier to stir or blend. Naturally the temperatures used during the blending operations should be controlled so as not to cause any significant amount of thermal degradation or unwanted chemical interactions.

When forming the lubricant compositions of this invention, it is usually desirable to introduce the additive ingredients into the base oil with stirring and application of mildly elevated temperatures, as this facilitates the dissolution of the components in the oil and achievement of product uniformity.

The following examples illustrate preferred additive concentrates and oleaginous compositions containing such concentrates. These examples are not intended to limit, and should not be construed as limiting, this invention.

EXAMPLE 1

Stage 1. To a reaction vessel are charged 43.4 parts of sulfurized isobutylene, 4.44 parts of dibutyl hydrogen phosphite, 4.99 parts of $C_{12}$–$C_{14}$ tertiary alkyl primary amine (Primene 81R; Rohm & Haas Chemical Company), 1.16 parts of 2-ethylhexyl acid phosphate, and 2.56 parts of process oil. Throughout this addition, wherein the sulfurized isobutylene, phosphite and amines are added in the order named, the components of the reaction vessel are agitated. An exothermic reaction occurs on bringing the sulfurized isobutylene, phosphite and amines into contact with each other, and the rate of addition is controlled so that the temperature does not exceed 60° C. Concurrently a slight negative pressure is maintained on the reaction vessel in order to remove any volatiles produced during the exothermic reaction. The temperature of the reaction vessel is maintained at 55°–60° C. for 60 minutes while continuing the agitation. The mixture is then cooled to 40° C. The pH of the resultant product is approximately 6.9.

Stage 2. In a separate reactor, 0.69 part of M-544 defoamant (Monsanto Chemical Company), 0.73 part of caprylic acid, 0.50 part of a mixture of $C_{12}$ and $C_{14}$ tert-alkyl primary monoamines (Primene 81R), and 2.87 parts of process oil are agitated together for 15 minutes. The solution so formed is added to the Stage 1 product. Concurrently, added is 19.63 parts of a product formed by reaction of dicyclopentadiene with dithiophosphoric acid-0,0-dialkyl ester in which on a molar basis 40% of the alkyl groups are isopropyl, 40% are isobutyl and 20% are 2-ethylhexyl. Agitation is continued for 15 minutes, and the temperature is kept at 30°–40° C. The pH of the resultant solution is approximately 6.9.

Stage 3. To the agitated solution of Stage 2 is added 3.0 parts of 2,5-dimethylthio-1,3,4-thiadiazole and 16.03 parts of process oil. Agitation is continued for 15 minutes while keeping the temperature at 30°–40° C. The finished product is a bright clear amber liquid typically having a sulfur content of about 23.7% (wt) and a phosphorus content of about 2.35% (wt). When dissolved in a refined 650 Solvent Neutral mineral oil at a concentration of 2.15% (wt), the product exhibits a copper corrosion rating of lb or better in the ASTM D-130 test modified as described hereinafter.

For automotive gear oil usage, this additive concentrate is preferably used at a treat level of 5.5% by weight based on the total weight of the finished oil. For industrial gear oil usage, the recommended treat level is 2.15% by weight.

EXAMPLE 2

Stage 1. The procedure of Stage 1 of Example 1 is repeated using 34.97 parts of sulfurized isobutylene, 3.00 parts of dibutyl hydrogen phosphite, 5.60 parts of $C_{16-18}$ alkyl monoamine, 0.01 part of n-octyl amine, 0.98 part of 2-ethylhexyl acid phosphate, and 2.65 parts of process oil.

Stage 2. The product of Stage 1 is cooled to 40° C. with continued agitation. Added to this product after the temperature reaches 40° C., is 16.61 parts of a product formed by reaction of dicyclopentadiene with dithiophosphoric acid-0,0-dialkyl ester in which on a molar basis 40% of the alkyl groups are isopropyl, 40% are isobutyl and 20% are 2-ethylhexyl.

Stage 3. In a separate reactor, 0.58 part of M-544 defoamant (Monsanto Chemical Company), 0.62 part of caprylic acid, 0.62 part of a $C_{36}$ dicarboxylic acid (formed by dimerization of oleic acid), and 2.65 parts of process oil are agitated together for 15 minutes. The resulting solution is added to the product from Stage 2. Agitation is continued for 15 minutes. The mixture so formed has a pH in the range of 6.0 to 7.0.

Stage 4. To the agitated mixture of Stage 3 are added 2.6 parts of 2,5-dimethylthio-1,3,4-thiadiazole and 2.65 parts of process oil. After these two components are added, 0.75 parts of dibutyl hydrogen phosphite is added to the mixture. Agitation is continued for 15 minutes.

Stage 5. To the agitated mixture of Stage 4 are added 23.07 parts of a mixture composed of 55% (wt) of a boronated succinimide (HiTEC® 648 additive; Ethyl Petroleum Additives, Inc.; Ethyl Petroleum Additives, Ltd.; Ethyl S.A.; Ethyl Canada Ltd.) and 45.% (wt) of process oil, and 2.65 parts of additional process oil. Agitation is continued for 15 minutes to ensure complete blending of the components. The finished product is pumped through a filter. The product is a bright clear amber liquid typically containing, on a weight basis, about 19.3% sulfur, about 2.0% phosphorus, about 0.62% nitrogen, and about 0.16% boron. The product as formed has a pH in the range of 6.0 to 7.0. When dissolved in a refined 650 Solvent Neutral mineral oil at a concentration of 2.54% (wt), the product exhibits a copper corrosion rating of 1*b* or better in the ASTM D-130 test modified as described hereinafter.

For automotive gear oil usage, this additive concentrate is preferably used at a treat level of 6.5% by weight based on the total weight of the finished oil. For industrial gear oil usage, the recommended treat level is 2.5% by weight.

EXAMPLE 3

Stage 1. The procedure of Stage 1 of Example 1 is repeated using 31.26 parts of sulfurized isobutylene, 2.44 parts of dibutyl hydrogen phosphite, 3.18 parts of $C_{16-18}$ alkyl monoamine, 0.63 part of n-octyl amine, 0.80 part of 2-ethylhexyl acid phosphate, and 5.19 parts of process oil. The pH of the resulting mixture is approximately 7.0.

Stage 2. In a separate reactor, 0.47 part of M-544 defoamant (Monsanto Chemical Company), 0.51 part of caprylic acid, 0.51 part of $C_{36}$ dicarboxylic acid (formed by dimerization of oleic acid), and 5.19 parts of process oil are agitated together for 15 minutes. The solution so formed is added to the Stage 1 product. Concurrently, added is 10.66 parts of a product formed by reaction of dicyclopentadiene with dithiophosphoric acid-0,0-dialkyl ester in which on a molar basis 40% of the alkyl groups are isopropyl, 40% are isobutyl and 20% are 2-ethylhexyl. Agitation is continued for 60 minutes, and the temperature is kept at 40° C. The pH of the resultant solution is approximately 6.9.

Stage 3. To the agitated solution of Stage 2 is added 2.14 parts of 2,5-dimethylthio-1,3,4-thiadiazole and 5.19 parts of process oil. Then 0.61 part of dibutyl hydrogen phosphite is added to the mixture. Agitation is continued for 15 minutes.

Stage 4. To the agitated solution from Stage 3 are added 10.32 parts of a mixture composed of 55% (wt) of a boronated succinimide (HiTEC® 648 additive; Ethyl Petroleum Additives, Inc.; Ethyl Petroleum Additives, Ltd.; Ethyl S. A.; Ethyl Canada Ltd.) and 45.% (wt) of process oil, 6.24 parts of alkenylsuccinimide (formed from ammonia and alkenyl succinic anhydride produced from a mixture of olefins made by isomerizing a 1-olefin mixture containing 49% $C_{20}$, 42% $C_{22}$, and 8% $C_{24}$ 1-olefins, and 14.66 parts of additional process oil. Agitation is continued for 15 minutes to ensure complete blending of the components. The finished product is pumped through a filter. The product is a bright clear amber liquid typically containing, on a weight basis, about 17.5% sulfur, and about 1.6% phosphorus. The product as formed has a pH in the range of about 6.60 to about 6.9. When dissolved in a refined 650 Solvent Neutral mineral oil at a concentration of about 3.1% (wt), the product exhibits a copper corrosion rating of 1*b* or better in the ASTM D-130 test modified as described hereinafter.

For automotive gear oil usage, this additive concentrate is preferably used at a treat level of 8% by weight based on the total weight of the finished oil. For industrial gear oil usage, the recommended treat level is 3.1% by weight.

The procedure used in determining pH in accordance with this invention involves diluting the sample of the composition in a mixture of methanol and toluene and then assaying "non-aqueous" pH with a conventional pH probe as used in aqueous systems. For this purpose, the basic equipment used is a potentiometer such as Beckman Zeromatic IV pH meter, Beckman Instruments Inc., available from CMS, catalog number 257-902, or equivalent; a glass indicating electrode 0-11 pH range, available from CMS, catalog number 39322 or equivalent; indicating electrode cable, available from Beckman Instruments Inc., catalog number 598979, or equivalent; saturated calomel reference electrode with ground glass sleeve junction, available from CMS, catalogue number 39420, or equivalent; and reference electrode cable, available from Beckman Instruments Inc., catalog number 598982, or equivalent. The reagents used in this procedure are reagent grade toluene; potassium chloride; reagent grade methanol; buffer solution, pH 7.00, available from CMS, catalog number 061-622, or equivalent; buffer solution, pH 10.00, available from CMS, catalog number 061-648, or equivalent; and buffer solution, pH 4.00, available from CMS, catalog number 061-614, or equivalent. The steps used in the procedure are as follows:

A. If the sample solution is expected to fall between the pH of 4.0 and 7.0, standardize the pH meter with these pH buffers. If the sample solution is expected to fall between the pH of 7.0 and 10.0, standardize the pH meter with these pH buffers. In standardizing with buffers standardize first with the buffer having a pH more remote from the suspected pH of the sample than the other buffer, and then use that other buffer.

B. It is important to have a linear range over which the measurements are to be made. Therefore, repeat all of step A until no adjustments are needed in order to have a linear pH scale.

C. Rinse the electrodes with distilled water, and blot dry with a clean, dry tissue.

D. Using a top loading balance, weigh 1.0±0.05 g of sample into a 150-mL beaker.

E. Add 50.0 mL by graduated cylinder of 1:1 volume of toluene and methanol. Alternatively, dissolve in 25.0 mL of toluene and then further dilute with 25.0 mL of methanol.

F. Place a stirring bar into the beaker containing the sample and solvents and place on a magnetic stirrer.

G. Insert the electrodes, turn on the pH meter, and stir for one minute.

H. Record the pH to the nearest 0.05 pH unit.

I. If recording more than one pH, rinse the electrodes with heptane, and with distilled water, and then blot dry with tissue, and then repeat steps F to H. When measurements have been completed, rinse the electrodes with distilled water and immerse them in a beaker of water for storage.

Copper corrosion ratings for the purposes of this invention are conducted using the standard ASTM D-130 procedure modified to the extent that the additive concentrate to be tested is first stored in an oven for 120 hours at 65° C. Then the concentrate is blended into the test oil to the selected test concentration and the test is conducted at 121° C.

The enhanced storage stability of the additive compositions of this invention was demonstrated in a series of storage tests. In these tests, an additive composition formed as in Example 2 was stored at ambient temperatures, in one case while in an open container exposed to the atmosphere and in another case, in an open container under conditions of 100% relative humidity. Also subjected to these storage tests were samples of the corresponding additive composition which did not contain sufficient amine to achieve the pH conditions of this invention but instead had a pH of in the range of 5.3 to 5.9. The results of these tests are shown in the following table.

RESULTS OF STORAGE TESTS

| Composition | Time to Haze Formation; Exposure to Air | Time to Haze Formation; Exposure to 100% Humidity |
|---|---|---|
| This Invention | 10 Days | 2 Days |
| Not of This Invention | 1 Day | 1.5 Hours |

This invention is susceptible to considerable variation. Thus it is not intended that this invention be limited by the specific exemplifications set forth hereinabove. Rather what is intended to be covered is the subject matter within the spirit and scope of the ensuing claims.

What is claimed is:

1. In the formation of an additive concentrate comprising (i) at least one oil-soluble, acidic organic additive selected from the group consisting of (a) one or more hydrocarbyl phosphoric acids, (b) one or more carboxylic acids, and (c) a combination of (a) and (b), and (ii) at least one oil-soluble ashless boronated dispersant, and wherein said additive concentrate would have a pH below 6, the improvement which comprises including in said concentrate one or more oil-soluble amines in an amount such that the pH of the finished concentrate as formed falls in the range of about 6.0 to about 7.0, and introducing the boronated dispersant into the concentrate when the pH of the concentrate being formed is at least about 6.0, each said pH being determined in accordance with the method described in the specification hereof.

2. The improvement of claim 1 wherein said boronated dispersant is introduced into the concentrate when said pH of the concentrate being formed is in the range of about 6.4 to about 7.0.

3. The improvement of claim 1 wherein said boronated dispersant is introduced into the concentrate when said pH of the concentrate being formed is in the range of about 6.60 to about 6.95.

4. The improvement of claim 1 wherein said boronated dispersant is introduced into the concentrate when said pH of the concentrate being formed is in the range of about 6.70 to about 6.95.

5. In an additive concentrate comprising at least one oil-soluble amine salt of a dihydrocarbyl monothiophosphoric acid, at least one oil-soluble active-sulfur-containing antiwear or extreme pressure agent, and a complement of oil-soluble acidic organic additives at least one of which is a hydrocarbyl phosphoric acid such that said additive concentrate would have a pH below 6, the improvement wherein said concentrate contains a sufficient amount of oil-soluble primary amine to provide a concentrate having a pH in the range of about 6.0 to about 7.0, the determination of the aforesaid pH values being in accordance with the method described in the specification hereof.

6. A concentrate as claimed in claim 5 wherein said at least one oil-soluble amine salt consists essentially of a salt formed by charging to a reactor the following components in the following order: (1) at least one active-sulfur-containing component, (2) at least one dihydrocarbyl hydrogen phosphite, and (3) at least one amine; and while agitating the reactor contents, controlling and maintaining the temperature at about 55 to about 60° C.

7. A concentrate as claimed in claim 6 wherein said at least one active-sulfur-containing component consists essentially of sulfurized olefin, wherein said at least one dihydrocarbyl hydrogen phosphite consists essentially of dialkyl hydrogen phosphite, and wherein said at least one amine consists essentially of aliphatic monoamine having in the range of about 8 to about 24 carbon atoms per molecule.

8. A concentrate as claimed in claim 5 wherein said pH is in the range of about 6.4 to about 7.0.

9. A concentrate as claimed in claim 5 wherein said pH is in the range of about 6.60 to about 6.95.

10. A concentrate as claimed in claim 5 wherein said pH is in the range of about 6.70 to about 6.95.

11. A concentrate as claimed in claim 5 wherein said oil-soluble primary amine consists essentially of one or more aliphatic monoamines having in the range of about 14 to about 24 carbon atoms per molecule.

12. A concentrate as claimed in claim 5 wherein said oil-soluble primary amine consists essentially of (a) one or more aliphatic monoamines having in the range of 14 to about 24 carbon atoms per molecule, and (b) up to about one-third of the weight of (a) of one or more aliphatic monoamines having in the range of about 8 to 13 carbon atoms per molecule.

13. A concentrate as claimed in claim 5 wherein said oil-soluble primary amine consists essentially of (a) a mixture of $C_{16}$ and $C_{18}$ alkyl monoamines, and (b) up to about one-third of the weight of (a) of one or more aliphatic monoamines having in the range of about 8 to 15 carbon atoms per molecule.

14. A concentrate as claimed in claim 5 wherein said oil-soluble primary amine consists essentially of (a) a mixture of $C_{16}$ and $C_{18}$ alkyl monoamines, and (b) up to about one-third of the weight of (a) of octyl amine.

15. A concentrate as claimed in claim 5 wherein said complement of oil-soluble acidic organic additives additionally comprises (a) at least one aliphatic monocarboxylic acid, (b) at least one aliphatic polycarboxylic acid, or (c) a combination of (a) and (b).

16. A concentrate as claimed in claim 5 wherein said additive concentrate further comprises at least one oil-soluble ashless dispersant.

17. A concentrate as claimed in claim 16 wherein said oil-soluble ashless dispersant consists essentially of a boron-containing ashless dispersant and wherein the boron-containing ashless dispersant is introduced into the concentrate after the pH thereof is at least about 6.0.

18. A concentrate as claimed in claim 5 wherein said additive concentrate further comprises at least one oil-soluble copper corrosion inhibitor in an amount such that the concentrate exhibits a 1*b* rating or better in the ASTM D-130 procedure in the form referred to in the specification hereof.

19. A concentrate as claimed in claim 18 wherein the pH of said concentrate is in the range of about 6.70 to about 6.95.

20. A concentrate as claimed in claim 5 wherein:

A) said at least one oil-soluble amine salt of a dihydrocarbyl monothiophosphoric acid is formed by a process which comprises (i) introducing, at a rate such that the temperature does not exceed about 60° C., dialkyl hydrogen phosphite into sulfurized branched-chain olefin while agitating the mixture so formed, (ii) introducing into this mixture, at a rate such that the temperature does not exceed about 60° C., one or more aliphatic primary monoamines having in the range of about 8 to about 24 carbon atoms in the molecule while agitating the mixture so formed, and (iii) maintaining the temperature of the resultant agitated reaction mixture at between about 55 and about 60° C. until reaction is substantially complete;

B) said complement of oil-soluble acidic organic additives includes at least one hydrocarbyl phosphoric acid consisting essentially of dialkyl phosphoric acid or a combination of dialkyl phosphoric acid and monoalkyl phosphoric acid, and said dialkyl phosphoric acid or combination of dialkyl phosphoric acid and monoalkyl phosphoric acid is present in the reaction mixture of A) during at least a portion of the time (iii) thereof is being conducted;

C) said complement of oil-soluble acidic organic additives also includes at least one aliphatic dicarboxylic acid having about 36 carbon atoms in the molecule; and D) said concentrate further includes at least one oil-soluble copper corrosion inhibitor in an amount such that the concentrate exhibits a 1*b* rating or better in the ASTM D-130 procedure in the form referred to in the specification hereof.

21. A concentrate as claimed in claim 20 wherein said concentrate further comprises (a) at least one oil-soluble succinimide, (b) at least one oil-soluble succinic ester, or (c) at least one oil-soluble succinic ester-amide, or a combination of any two or all three of (a), (b) and (c).

22. A concentrate as claimed in claim 20 wherein said concentrate further comprises (a) at least one oil-soluble boronated succinimide, (b) at least one oil-soluble boronated succinic ester, or (c) at least one oil-soluble boronated succinic ester-amide, or (d) a combination of any two or all three of (a), (b) and (c), whichever of the foregoing (a), (b), (c) or (d) is included in the concentrate being introduced therein after the pH thereof is at least about 6.0.

23. An ashless additive concentrate formed from at least the following: (a) at least one oil-soluble sulfur-containing antiwear and/or extreme pressure agent, (b) at least one oil-soluble phosphorus-containing antiwear and/or extreme pressure agent, (c) at least one oil-soluble acidic organic additive, (d) at least one oil-soluble amine, and (e) at least one oil-soluble boronated ashless dispersant; said concentrate being further characterized in that (i) in the absence of component (d) the pH of the concentrate is 6.0 or below, (ii) component (d) is employed in an amount sufficient to cause the pH of the concentrate to be in the range of about 6.0 to about 7.0, and (iii) component (e) is introduced into the concentrate when the pH thereof is at least about 6.0, the determination of the aforesaid pH values being in accordance with the method described in the specification hereof.

24. A concentrate as claimed in claim 23 wherein (a) thereof consists essentially of sulfurized isobutylene, wherein (b) thereof consists essentially of amine salt of dibutyl monothiophosphoric acid, wherein (c) thereof consists essentially of a combination of at least one oil-soluble dialkyl phosphoric acid and at least one oil-soluble carboxylic acid, wherein (d) thereof consists essentially of one or more aliphatic monoamines having in the range of about 8 to about 24 carbon atoms in the molecule, and wherein (e) thereof consists essentially of at least one boronated succinimide.

25. A concentrate as claimed in claim 24 wherein said boronated succinimide consists essentially of a composition formed by boronating a succinimide ashless dispersant formed by reacting (i) a polyisobutenyl succinic acylating agent derived from polyisobutene having a number average molecular weight in the range of about 500 to about 5,000 with (ii) a mixture of cyclic and acyclic polyethylene polyamines having an approximate average overall composition in the range of diethylene triamine to pentaethylene hexamine.

26. A concentrate as claimed in claim 25 wherein said polyisobutene has a number average molecular weight in the range of about 700 to about 2,500, wherein said mixture of cyclic and acyclic polyethylene polyamines has an approximate average overall composition of tetraethylene pentamine, and wherein said succinimide ashless dispersant is boronated by reaction with boric acid.

27. A concentrate as claimed in claim 26 wherein said concentrate further comprises at least one oil-soluble copper corrosion inhibitor in an amount such that the concentrate exhibits a 1b rating or better in the ASTM D-130 procedure in the form referred to in the specification hereof.

28. A concentrate as claimed in claim 27 wherein said copper corrosion inhibitor consists essentially of 2,5-dimethylthio-1,3,4-thiadiazole.

29. A concentrate as claimed in claim 23 wherein (a) thereof consists essentially of sulfurized isobutylene, wherein (b) thereof consists essentially of amine salt of dibutyl monothiophosphoric acid, wherein (c) thereof consists essentially of a combination of di-2-ethylhexylphosphoric acid and mono-2-ethylhexylphosphoric acid and a dimer acid having about 36 carbon atoms in the molecule, wherein (d) thereof consists essentially of one or more aliphatic monoamines having in the range of about 8 to about 24 carbon atoms in the molecule, and wherein (e) thereof consists essentially of at least one boronated succinimide formed by boronating a succinimide ashless dispersant formed by reacting (i) a polyisobutenyl succinic acylating agent derived from polyisobutene having a number average molecular weight in the range of about 500 to about 5,000 with (ii) a mixture of cyclic and acyclic polyethylene polyamines having an approximate average overall composition in the range of diethylene triamine to pentaethylene hexamine, wherein said concentrate further comprises at least one oil-soluble copper corrosion inhibitor in an amount such that the concentrate exhibits a **1*b*** rating or better in the ASTM D-130 procedure in the form referred to in the specification hereof, and wherein (d) thereof is employed in an amount sufficient to cause said pH of said concentrate to be in the range of about 6.70 to about 6.95.

30. A concentrate as claimed in claim 29 wherein said polyisobutene has a number average molecular weight in the range of about 700 to about 2,500, wherein said mixture of cyclic and acyclic polyethylene polyamines has an approximate average overall composition of tetraethylene pentamine, and wherein said succinimide ashless dispersant is boronated by reaction with boric acid.

31. In the method of forming an additive concentrate from a plurality of oil-soluble components which include at least one acidic organic component and at least one boronated ashless dispersant by blending the components of the concentrate concurrently or sequentially and individually or in one or more subcombinations such that said additive concentrate would have a pH below 6, the improvement which comprises (a) including as at least one component in such blending operation a sufficient amount of oil-soluble amine to adjust the pH of the concentrate to at lest 6.0, and (b) blending such one or more boronated ashless dispersants into the concentrate such that at no point in the blending is such at least one boronated ashless dispersant exposed to a pH below 6.0, the determination of the aforesaid pH values being in accordance with the method described in the specification hereof.

32. The improvement according to claim 31 wherein said plurality of oil-soluble components further comprises at least one oil-soluble active-sulfur-containing antiwear and/or extreme pressure agent and at lest one oil-soluble phosphorus-containing antiwear and/or extreme pressure agent; wherein the oil-soluble amine consists essentially of one or more aliphatic primary amines; and wherein the pH of the finished concentrate as determined in accordance with the method described in the specification hereof is in the range of 6.0 and 7.0.

33. The improvement according to claim 32 wherein said plurality of oil-soluble components further comprises at least one oil-soluble copper corrosion inhibitor in an amount such that the concentrate exhibits a **1*b*** rating or better in the ASTM D-130 procedure in the form referred to in the specifications hereof, and wherein said pH of the finished concentrate as formed is in the range of about 6.40 to about 6.95.

34. The improvement according to claim 33 wherein said pH is in the range of about 6.70 to about 6.95.

35. The improvement according to claim 33 wherein said boronated ashless dispersant consists essentially of boronated succinimide formed by boronating a succinimide ashless dispersant formed by reacting a polyisobutenyl succinic acylating agent derived from polyisobutene having a number average molecular weight in the range of about 500 to about 5,000 with a mixture of cyclic and acyclic polyethylene polyamines having a approximate average overall composition in the range of diethylene triamine to pentaethylene hexamine.

36. In an additive concentrate comprising at least one oil-soluble amine salt of a dihydrocarbyl monothiophosphoric acid, at least one oil-soluble active-sulfur-containing antiwear or extreme pressure agent, and a complement of oil-soluble acidic organic additives at least one of which is carboxylic acid, and wherein said additive concentrate would have a pH below 6, the improvement wherein said concentrate contains a sufficient amount of oil-soluble primary amine to provide a concentrate having a pH in the range of about 6.0 to about 7.0, the determination of the aforesaid pH values being in accordance with the method described in the specification hereof.

37. A composition according to claim 36 wherein said carboxylic acid is a combination of carboxylic acids comprising at least caprylic acid and a $C_{36}$ dimer acid.

38. In the formation of an additive concentrate comprising (i) at least one oil-soluble, carboxylic acid organic additive and (ii) at least one oil-soluble ashless boronated dispersant, and wherein said additive concentrate would have a pH below 6, the improvement which comprises including in said concentrate one or more oil-soluble amines in an amount such that the pH of the finished concentrate as formed falls in the range of 6.0 to about 7.0, and introducing the boronated dispersant into the concentrate when the pH of the concentrate being formed is at least 6.0, each said pH being determined in accordance with the method described in the Specification hereof.

39. The improvement of claim 38 wherein said boronated dispersant is introduced into the concentrate when said pH of the concentrate being formed is in the range of about 6.4 to about 7.0.

40. The improvement of claim 38 wherein said boronated dispersant is introduced into the concentrate when said pH of the concentrate being formed is in the range of about 6.70 to about 6.95.

41. In an additive concentrate comprising at least one oil-soluble amine salt of a dihydrocarbyl monothiophosphoric acid, at least one oil-soluble active-sulfur-containing antiwear or extreme pressure agent, and a complement of oil-soluble acid organic additives at least one of which is a carboxylic acid such that said additive concentrate would have a pH below 6, the improvement wherein said concentrate contains a sufficient amount of oil-soluble primary amine to provide a concentrate having a pH in the range of 6.0 to about 7.0,the determination of the aforesaid pH values being in accordance with the method described in the Specification hereof.

42. A concentrate as claimed in claim 43 wherein said complement of oil-soluble acidic organic additives additionally comprises (a) at least one aliphatic monocarboxylic acid, (b) at least one aliphatic polycarboxylic acid, or (c) a combination of (a) and (b).

43. A concentrate as claimed in claim 41 wherein said additive concentrate further comprises at least one oil-soluble ashless dispersant.

44. A concentrate as claimed in claim 43 wherein said at least one oil-soluble amine salt consists essentially of a salt formed by charging to a reactor the following components in the following order: (1) at least one active-sulfur-containing component, (2) at least one dihydrocarbyl hydrogen phosphite and at least one carboxylic acid and (3) at least one amine; while agitating the reactor contents, controlling and maintaining the temperature at about 55° to about 60° C.

45. A concentrate as claimed in claim 43 wherein said at least one active-sulfur-containing component consists essentially of sulfurized olefin, wherein said at least one dihydrocarbyl hydrogen phosphite consists essentially of dialkyl hydrogen phosphite, and wherein said at least one amine consists essentially of aliphatic monoamine having in the range of about 8 to about 24 carbon atoms per molecule.

46. A concentrate as claimed in claim 43 wherein said pH is in the range of about 6.4 to about 7.0.

47. A concentrate as claimed in claim 43 wherein said pH is in the range of about 6.60 to about 6.95.

48. A concentrate as claimed in claim 43 wherein said pH is in the range of about 6.70 to about 6.95.

* * * * *